United States Patent [19]

Bol et al.

[11] Patent Number: 4,716,965

[45] Date of Patent: Jan. 5, 1988

[54] INSTALLING CASING WITH IMPROVED CASING/CEMENT BONDING

[75] Inventors: Gerardus M. Bol; Franciscus H. Meijs; Fredericus C. Schouten; Robert B. Stewart; Petrus C. De Roo, all of Rijswijk, Netherlands

[73] Assignee: Shell Oil Company, Houston, Tex.

[21] Appl. No.: 849,339

[22] Filed: Apr. 8, 1986

[30] Foreign Application Priority Data

Apr. 11, 1985 [GB] United Kingdom ..... 8509320

[51] Int. Cl.[4] ..... E21B 33/14

[52] U.S. Cl. ..... 166/292; 166/242

[58] Field of Search ..... 166/292, 285, 242, 243, 166/287, 289

[56] References Cited

U.S. PATENT DOCUMENTS

| | | | |
|---|---|---|---|
| 2,230,626 | 2/1941 | Miller | 166/287 |
| 3,110,346 | 11/1963 | Spurlock et al. | 166/285 |
| 3,387,656 | 6/1968 | Guest et al. | 166/242 |
| 3,387,661 | 6/1968 | Evans et al. | 166/243 |
| 3,918,522 | 11/1975 | Suman, Jr. | 166/285 |
| 4,440,226 | 4/1984 | Suman, Jr. | 166/250 |
| 4,495,997 | 1/1985 | Scott et al. | 166/242 |
| 4,607,698 | 8/1986 | Wood | 166/285 |

*Primary Examiner*—Stephen J. Novosad
*Assistant Examiner*—Terry Lee Melius

[57] ABSTRACT

In order to prevent gas migration along the outer surface of a casing which is cemented in a well, the casing is provided with casing-surrounding sheaths of an elastomeric foam, which sheaths are able to seal-off the spacing that may be formed between the casing and the cement.

7 Claims, 1 Drawing Figure

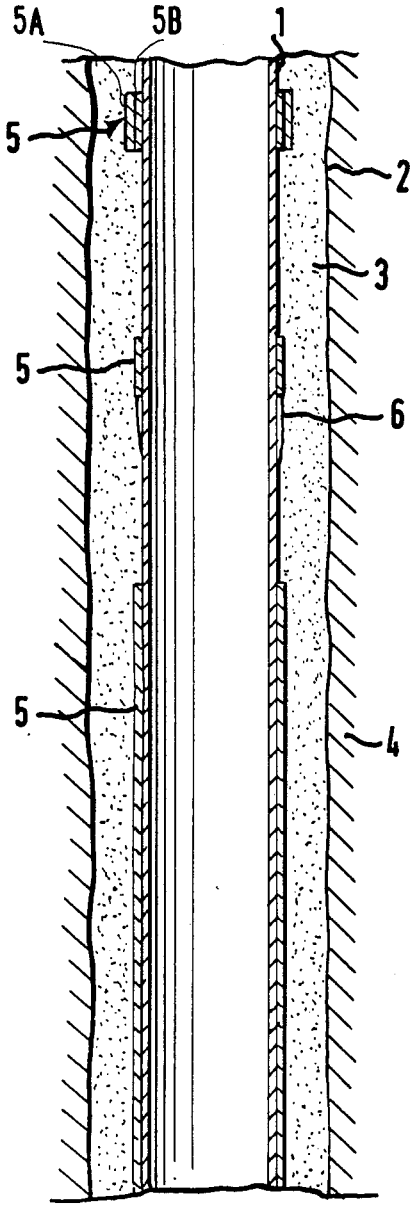
5A
5B
1
5
2
3
5
6
5
4

INSTALLING CASING WITH IMPROVED CASING/CEMENT BONDING

BACKGROUND OF THE INVENTION

The invention relates to a method of installing and cementing a casing in an oil and/or gas well.

During well completion operations it is common practice to install a well casing by first suspending the casing in the well and then pumping a cement slurry into the annular space between the outer surface of the casing and the borehole wall. After the cement has set to a hardened mass, perforations may be extended through the casing and the cement body into the production zones of the earth formation around the well in order to allow inflow of valuable formation fluids such as oil or gas into the well.

The purpose of the cement body around the casing is to fix the casing in the well and to seal the borehole around the casing in order to prevent vertical flow of fluid alongside the casing towards other formation layers or even to the earth surface. Thus, it is essential that a good bonding is created between the cement body and both the casing and the borehole wall.

A problem generally encountered during cementation of the casing in a well is that due to various factors, such as the existence of varying pressure and temperature gradients along the length of the casing and shrinkage of the cement body during hardening thereof, relative displacements occur between the casing and the hardening cement mass which may result in poor bonding between the cement body and the casing. Such poor bonding may result in the presence of a so-called micro-annulus between the casing and the cement body, which micro-annulus may extend along a substantial part of the length of the casing. The occurrence of a micro-annulus is particularly dangerous in gas wells as substantial amounts of gas might escape therethrough to the surface.

Various attempts have been made to improve bonding between well casings and the surrounding cement bodies. It is common practice to use cement compositions with additives that improve adhesion of the cement body to the formation and to the wall of the casing, and to use foam cements that shrink during hardening thereof only to a minor extent. It is also know, for example from U.S. Pat. Nos. 3,918,522 and 4,440,226 to provide the casing with an inflatable packer which is filled with cement. A problem encountered when using such packers is that they are fragile and require a complex cementation procedure.

SUMMARY OF THE INVENTION

It is an object of the invention to provide a well completion method and system in which a fluid tight seal is created between the well casing and the surrounding cement body. which seal can be easily installed.

In accordance with the invention this object is accomplished by a well completion method which comprises the steps of: surrounding the outer surface of at least a portion of a well casing with a sheath of an elastomeric foam capable of remaining resilient after compression thereof by the hydrostatic pressure of a cement slurry; pumping a cement slurry into the annulus between the casing and borehole wall and curing the cement.

DESCRIPTION OF THE DRAWING

The drawings is a schematic view of a well in which a casing is cemented in accordance with this invention.

DESCRIPTION OF THE INVENTION

In a preferred embodiment of the invention the casing-surrounding sheath consists of alternatingly arranged layers of a closed cell polyurethane foam and a closed cell polyethylene foam, which layers have at atmospheric pressure a density between about 300 and 1100 kg/m$^3$.

It is generally preferred to select the thickness of the sheath around the casing between about 1 and 30 mm.

The invention will now be described in more detail with reference to the drawing, showing a well in which a casing 1 is installed. The casing 1 is cemented to the borehole wall 2 by means of a body 3 of cement, which is preferably a surfactant-containing cement. Where desired, the cement may be foamed. The well section shown in the drawing is located just above the inflow area of the well (not shown) in which area perforations may be shot through the casing 1 and cement body 3 into an earth formation 4 containing valuable fluid such as oil and gas.

The casing 1 is, at selected locations along the length thereof, provided with at least one sheath 5 of an elastomeric foam. Each sheath 5 is bonded to the outer surface of the casing and preferably consists of alternating layers 5A and 5B of polyurethane foam and polyethylene foam, which layers have at atmospheric pressure a density of between 300 and 1100 kg/m$^3$.

Prior to running the casing string 1 into the well the sheaths 5 are bonded to the outer surface thereof with a conventional plastic bonding material. When the casing string is subsequently lowered through the well, the hydrostatic pressure of the drilling fluid compresses the sheaths 5, which remain resilient during that compression.

When the casing 1 is located in its desired position in the well a cement slurry is pumped via the interior of the casing 1 and the lower casing end upwards into the annulus, thereby causing the cement slurry to drive the drilling fluid out of the annulus. It is preferred, in order to ensure that all drilling fluid is displaced from the annulus, to inject the cement slurry at such a rate that the average upward velocity of the cement slurry through the annulus is more than 1 m/s.

As soon as the annulus around the casing 1 is sufficiently filled with the cement slurry, injection of cement into the well is stopped and the cement slurry is allowed to harden. As is well known in the art, hardening of cement causes generally a slight reduction of the volume of the cement. Although the shrinkage of the cement can be reduced to a minimum by using suitable additives in combination with a foamed or foam generating cement, said shrinkage will cause a tendency of the hardening cement to tear off from the outer casing wall whereby at some locations a gap or micro-annulus 6 may be formed between the casing 1 and the surrounding cement body 3.

Although the length of a micro-annulus 6 that may thus be formed during hardening of the cement may only extend along a small portion of the length of the casing 1, the length of the micro-annulus may increase gradually or suddenly after hardening of the cement body, for example due to varying temperature and pressure gradients inside the well, or due to casing corrosion or casing vibrations.

The purpose of the sheaths 5 is to interrupt propagation of such a micro-annulus 6 in axial direction along the casing. If, at the location of a sheath 5, a relative displacement between the casing 1 and cement body 3 occurs, either in axial, radial or tangential direction, the displacement will cause a deformation of the sheaths, but the resilient tendency toward expansion of the elastomeric foam layers of the sheath 5 will ensure good adhesion of the sheath to both the casing 1 and the surrounding cement body 3. In this way the fluid passage formed by the micro-annulus 6 is sealed off in axial direction by the sheath 5.

As illustrated, it is preferred to arrange the sheath 5 at regular axial intervals along the length of the casing 1.

It is preferred to arrange at thos locations where the seal is most needed, that is in the region of the inflow area of the well, some relatively long sheaths 5 at relatively short intervals and to provide the higher casing sections with relatively short sheaths 5 which are arranged at relatively long intervals. The average length of these short sheaths is generally between 1 and 50 cm, whereas the distance between two adjacent sheaths is generally between 1 and 20 m.

In the illustrated example the foam sheaths consist of a sandwich construction of alternating layers of polyurethane foam and polyethylene foam. These foam layers are interbonded up to a total sheath thickness which is at atmospheric pressure between 1 and 30 mm. In most gas wells the sheath thickness will be selected between 2 and 15 mm. The purpose of this sandwich construction of the foam layers is to provide a robust but flexible sheath which is able to expand in a resilient manner after compression thereof while only a low sheath thickness is required. The thickness of the sheaths should be as low as possible in order to avoid obstruction of the flow of the cement slurry through the annulus during cementation and to create an annular cement mass with an almost uniform thickness through its height.

What is claimed is:

1. In a cementing process in which a casing is suspended within a well and a slurry of cement is flowed into the space between the casing and the borehole wall and allowed to harden, an improvement for preventing fluid migration between the casing and cement, comprising:

surrounding at least one portion of the outer surface of the casing with a self supporting sheath of an elastomeric foam comprising alternately arranged layers of a closed cell polyurethane foam and a closed cell polyethylene foam which, together, are capable of remaining resilient and retaining the structural integrity of the sheath after compression by the hydrostatic pressure of a slurry of cement;

inflowing the cement slurry into the borehole around the casing and sheath; and allowing the cement to harden with the resilient tendency toward expansion of the elastomeric foam ensuring good adhesion of the sheath to both the casing and cement.

2. A method as claimed in claim 1, wherein the layers of the sheath have at atmospheric pressure a density of between 300 and 1100 $kg/m^3$.

3. A method as claimed in claim 1, wherein the cement slurry consists of a surfactant-containing foam cement having at atmospheric pressure a density of less than 1800 $kg/m^3$.

4. A method as claimed in claim 3, where the cement slurry is pumped through the annulus at a speed of more than 1 m/s.

5. A cementing process as claimed in claim 1, wherein the process further comprises surrounding at least a portion of the outer surface of the casing with a sheath of an elastomeric foam which sheath has a thickness of between about 1 and 30 mm.

6. A cement process as claimed in claim 5, wherein the process further comprises providing the casing with a series of sheaths which are arranged at selected axial intervals along the length of at least a portion of the casing.

7. A cementing process as claimed in claim 6, wherein the process further comprises spacing the length of each sheath between about 1 and 50 cm in the axial direction along the casing and spacing the distance between each pair of adjacent sheaths between about 1 and 20 m.

* * * * *